United States Patent [19]

Helmke

[11] Patent Number: 4,635,311

[45] Date of Patent: Jan. 13, 1987

[54] MILITARY TACTICAL BRIDGE SYSTEM, METHOD AND FOLDABLE MODULES

[75] Inventor: Richard W. Helmke, Stafford, Va.

[73] Assignee: The United States of America as represented by the Secretary of the Army, Washington, D.C.

[21] Appl. No.: 742,817

[22] Filed: Jun. 10, 1985

[51] Int. Cl.[4] ..... E01D 15/12

[52] U.S. Cl. ..... 14/2.4; 14/1; 182/63

[58] Field of Search ..... 14/1, 2.4, 2.6, 27; 182/63, 152

[56] References Cited

U.S. PATENT DOCUMENTS

| | | | |
|---|---|---|---|
| 3,411,167 | 11/1968 | Sedlacek | 14/1 |
| 3,820,181 | 6/1974 | Wagner et al. | 14/2.4 |
| 3,925,840 | 12/1975 | Wagner | 14/1 |
| 4,319,375 | 3/1982 | Mahncke | 14/2.4 |

FOREIGN PATENT DOCUMENTS

| | | | |
|---|---|---|---|
| 81388 | 6/1983 | United Kingdom | 14/2.4 |

*Primary Examiner*—James A. Leppink

*Assistant Examiner*—Matthew Smith

*Attorney, Agent, or Firm*—John E. Becker; Roger F. Phillips; Anthony T. Lane

[57] ABSTRACT

A folding tactical bridge module and bridging system and method of deploying and retrieval. Each module is made up of three longitudinally collapsible units interconnected and folded in a side-by-side arrangement to be carried by a bridge transporter vehicle. Each unit includes an arched roadway portion made up of two arcuate segments with a hinge at the centerline and a truss hingedly connected at each longitudinal edge. Tensile links tie the edges of the arched roadway together. The module folds in two ways with the tie links nested between the vertically collapsed first folded roadway segments which in turn are nested between a pair of vertical trusses. The three units of each module are in turn folded a second time into a side-by-side compact relation upon a transporter deploying vehicle. The bridge may be expanded and emplaced by the bridge transporter vehicle and its two-man crew using self-contained extendable-retractable interconnectable traversing beams associated with each of its three units.

20 Claims, 18 Drawing Figures

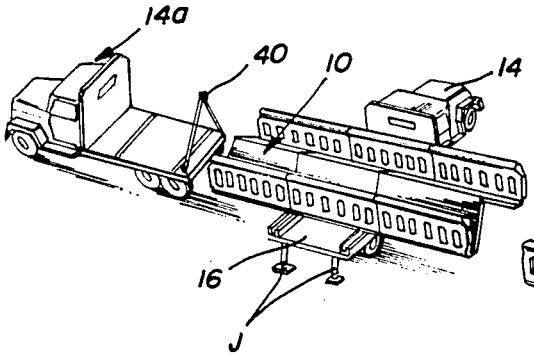
FIG. 3
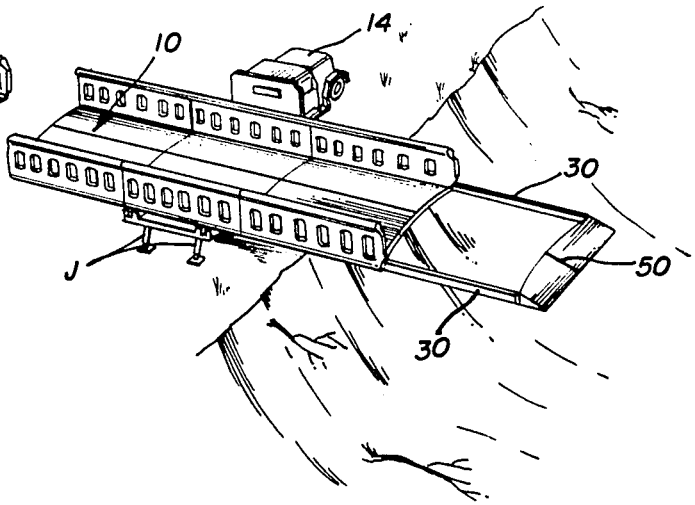
FIG. 4
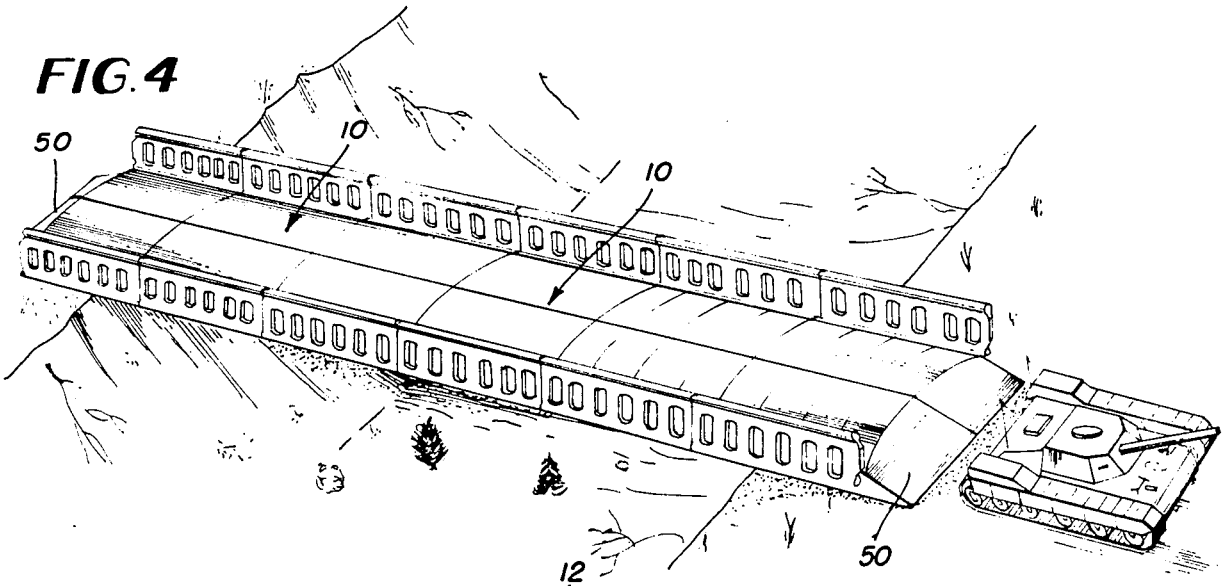
FIG. 14
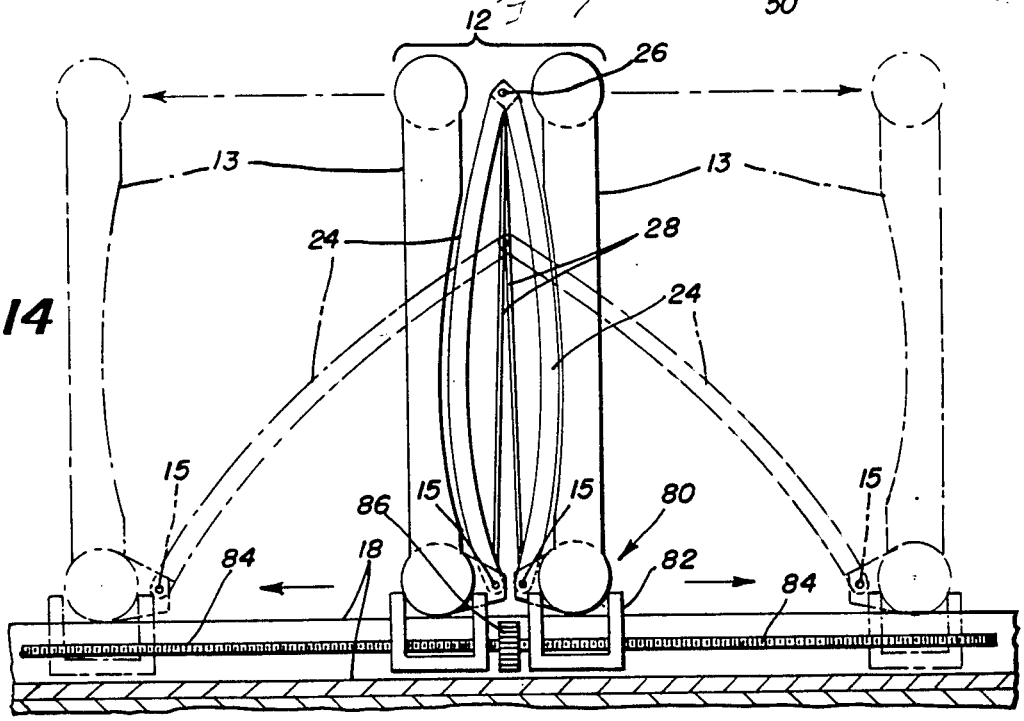

FIG. 8
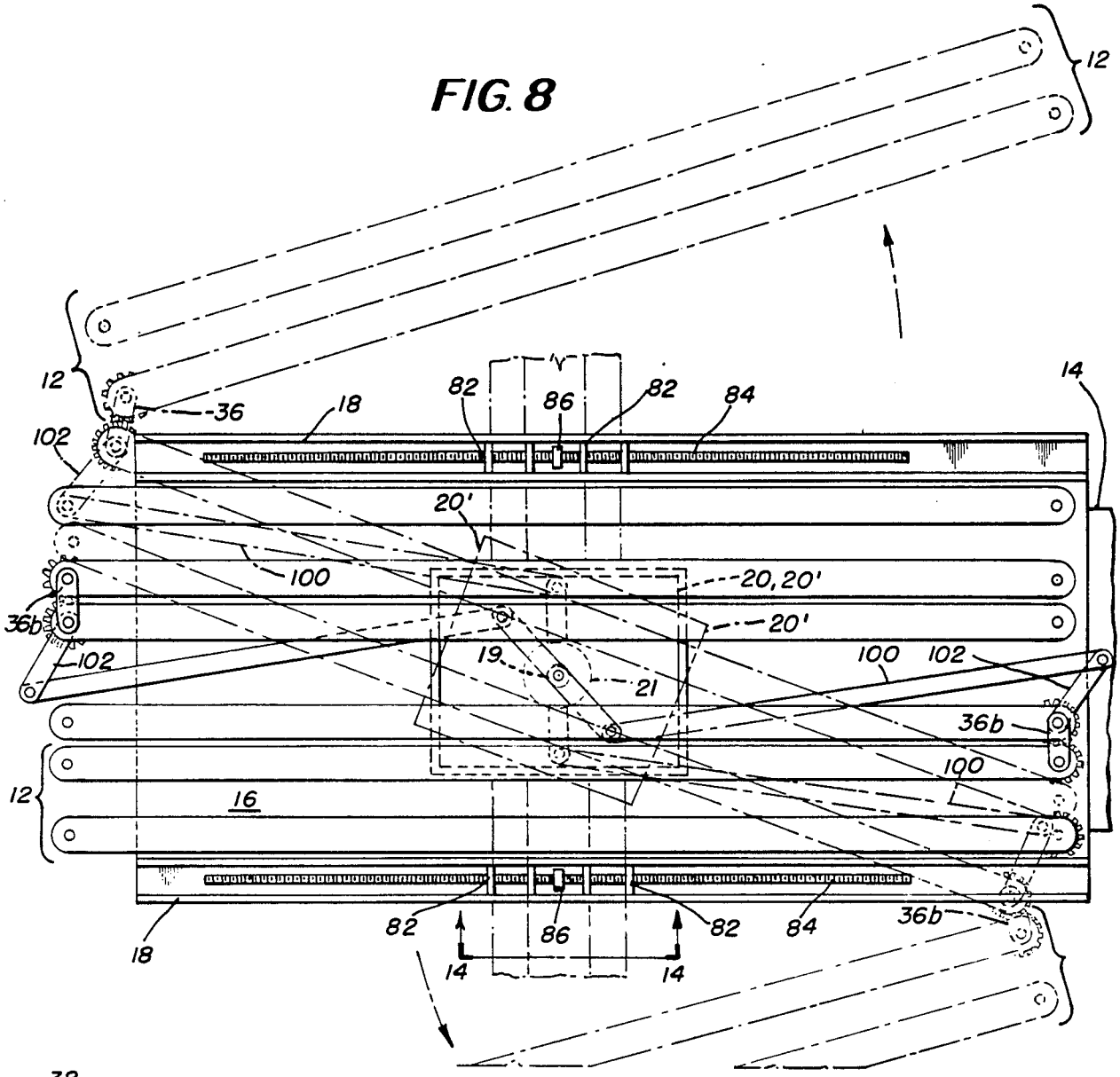
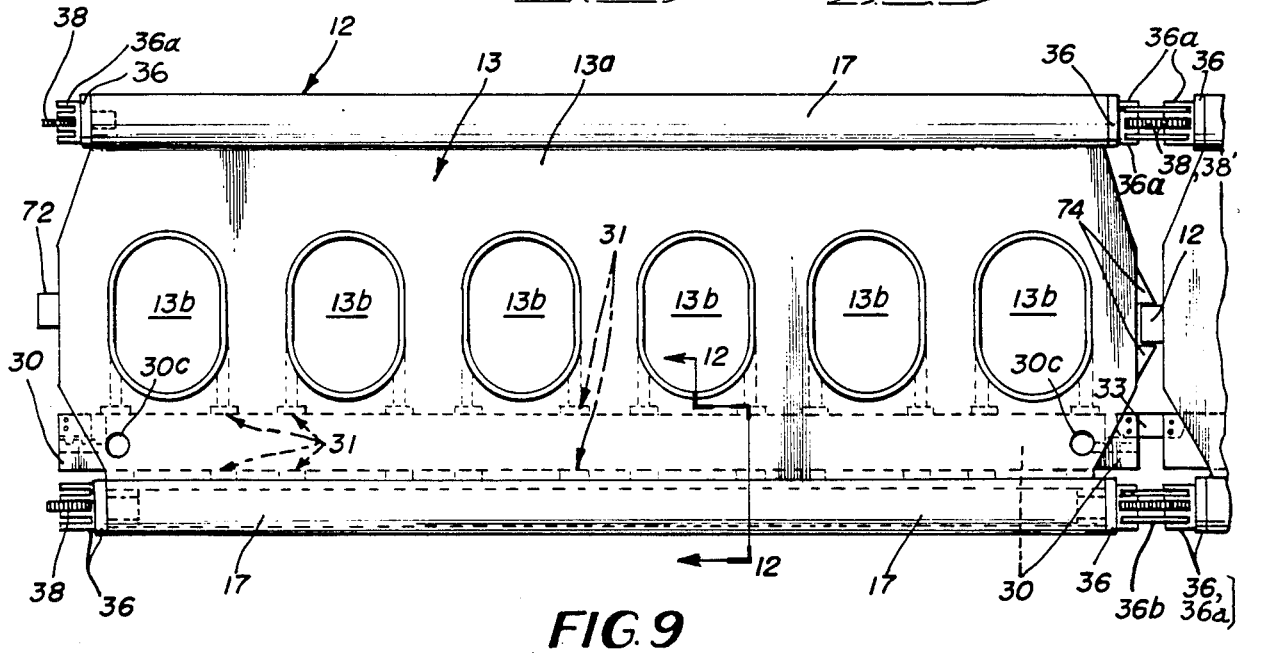
FIG. 9

MILITARY TACTICAL BRIDGE SYSTEM, METHOD AND FOLDABLE MODULES

GOVERNMENT INTEREST

The invention described herein may be manufactured, used, and licensed by or for the Government for governmental purposes without payment to me of any royalties thereon.

BACKGROUND OF THE INVENTION

1. Field of the Invention

The present invention relates broadly to military bridging. Military bridges are employed for crossing wet and dry gaps in three general situations: under enemy fire, for temporary mobility, and for long-term logistical support. The present invention is directed specifically to providing temporary bridging in support of tactical operations, while not under enemy fire, by utilizing a bridge module which includes foldable units carried by a bridge truck or transporter.

2. Description of the Related Art

Previously, the practice with bridge spans of this type has been to utilize structures wherein small slender elements are rigidly spaced into closed cellular geometries which are strong and stiff in both bending and torsion. The resulting roadways have box beams and space frames, both of which enclose large volumes of air and, thus, are bulky.

Prior military bridges are not known to have employed fibrous composite materials (graphite, Kevlar, glass, etc.) since these materials were considered to be too costly for such a structure. Also, it has always been assumed that labor is cheap and available for military purposes, such as the erection and placement of the bridges. In this regard, this is not the case where a mobile force is putting a bridge in place.

In the past, bridges made up of multiple duplicate components have been utilized. However, structural or mechanical repair in the field is not practical for a mobile force in view of the limited resources of such a force. The only field repair practical is replacement. Thus, bridges made up of modules which have few parts and can be scavanged and replaced are now necessary.

OBJECTS AND SUMMARY OF THE INVENTION

It is a primary object of the present invention to provide an improved military tactical bridge system which is easier to transport and put into position than the tactical bridges which were previously utilized.

It is also an object to combine wet (floating) and dry (spanning) tactical bridging capability into a single tactical bridge system and to devise a lighter weight, relatively compact three-unit foldable module which is adaptable to be carried by the Army's present modified 5-ton truck used currently as a standard transporter and deployer of its so-called Ribbon Bridge System.

It is a further object of the present invention to reduce the bulk of the bridge spans utilized, as well as the weight of the bridge spans utilized.

Another object of the present invention is to reduce the amount of manpower necessary to erect and emplace a bridge in the field.

An additional object of the present invention is to simplify the logistics involved in providing replacement parts for a mobile bridging system.

A further object of the present invention is to essentially enable a two-man crew to deploy the bridging system in approximately fifteen minutes This is quite an advantage as compared to conventional bridging systems which require two hours or longer for deployment.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

In accordance with the present invention, a unique three-unit foldable bridge module and bridge system is provided wherein an extra vehicle of the type used for transporting the modules is also the sole required power source for emplacement and retrieval of the bridge. Although the bridge can be put into place by a single two-man crew of one of the transport vehicles, it is more expeditious to use each transporter truck's two-man crews to collectively prepare the modules for deployment in cooperation with the other two-man crews at the site. The new bridge module itself is made up of three units which are vertically foldable and laterally hinged together, and in transit are carried by the transporter vehicles in the same folded configuration. Each unit includes a longitudinally split fixed-width arcuate in cross-section and three hinged tied-arch roadway supported between and at the base of two Veirendel trusses. The roadway comprises a circular tied-arch made up of adjoining groups of two-part arch roadway segments provided with a hinge at the centerline. The two opposite edges of the roadway are tied together at a number of locations by two aligned members or corresponding tensile link assemblies which have a hinge point directly beneath the aforesaid roadway hinged centerline. This particular choice of hinge points allows the roadway to fold vertically and thereby reduce the width of the bridge module from its deployed 14 feet width to about 30 inches transportable width. These tensile link assemblies are connected to the roadway edges by hinges and never drop below a horizontal chord line between connecting opposed hinges. When a unit is folded, the placement of hinges at the center and lateral edges of the roadway arch and on the tie centerlines allows the roadway to fold with the tie links nested between the two circular arch roadway segments, which in turn are nested between the two Veirendel trusses. The overall depth of the package is limited to essentially one-half the roadway width, which for a Military Class Load 60 allows the Veirendel truss to be about 2 meters (80 inches). The collapsed width of the bridge module is such that its three units can be stacked side-by-side and not exceed the width of the bridge transporter vehicle. The energy required for its lateral expansion and contraction is considered minimal.

Composite materials are utilized in selected areas of the structure since they have been found to be advantageous, both mechanically and economically. In particular, braided graphite fibers and epoxy materials are used in certain applications, such as in the make-up of the Vierendel type main truss chord tubular elements. The production of this braided material is accomplished through weaving and winding techniques which are low-labor-intensive and give machine quality with high tolerance control.

Another area of the bridge module where composite materials are relied upon is the tensile elements which form the tie links for connecting the edges of the roadway together.

The end fittings for the composite tubular truss elements are preferably braided in metallic threaded collars to provide simple clevis type pinned end joints. The necessary compressive stability of the top chords of the trusses is provided by such composite material tubular elements. All four tubular elements are identical and are easily replaceable.

BRIEF DESCRIPTION OF THE DRAWINGS

The present invention will become more fully understood from the detailed description given hereinbelow and the accompanying drawings which are given by way of illustration only, and thus are not limitative of the present invention.

FIG. 3 is a somewhat diagrammatic perspective view, the right-hand portion of which illustrates a bridge module which is completely unfolded, prior to deployment, and the left-hand portion of which illustrates an additional module in the process of being unfolded for adding to the first module;

FIG. 4 illustrates in perspective the two modules deployed in place across a chasm for use as a bridge;

FIG. 8 is a top plan view showing some exemplary details of an exemplary transporter truck bed, and showing the basic outline of the three units which comprise one of the bridge modules in diagrammatic top plan view both before any initiating unfolding part of deployment and also showing them in a partial beginning stage of unfolding for deployment;

FIG. 9 depicts an outward side elevational view of one full truss-supported unit in association at the right side with a fragmentary end portion of another such unit to illustrate the adjoining relationship preparatory to deployment;

FIG. 14, which appears on the same sheet with FIGS. 3 and 4, is an enlarged fragmentary side elevational view as taken on line 14—14 in the lower portion of FIG. 8. It depicts the controlled unfolding of the vertically collapsed roadway and truss elements;

DETAILED DESCRIPTION OF THE PREFERRED EMBODIMENT

Figure 1:
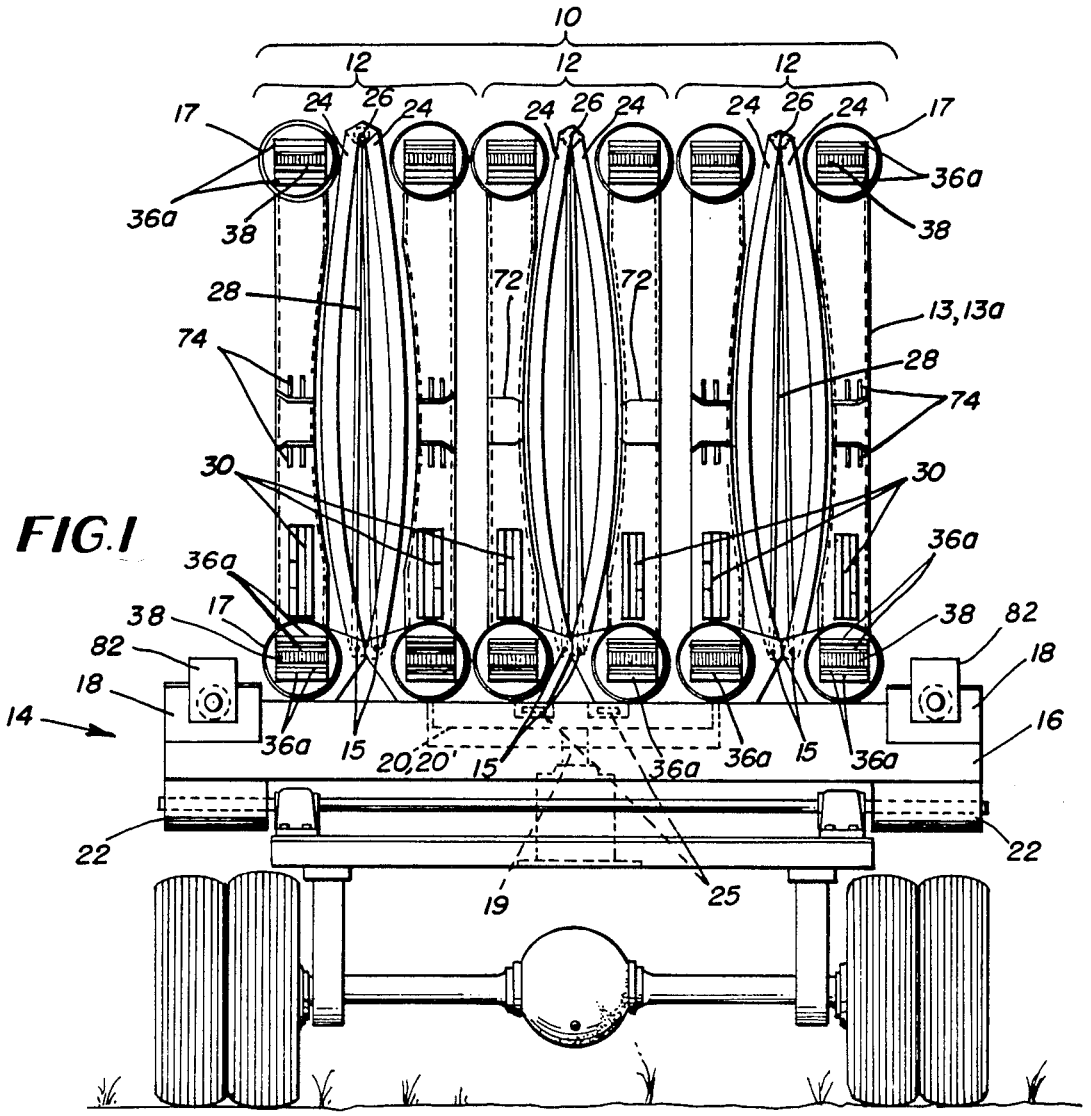
FIG. 1 illustrates an end elevation of a folded three-unit bridge module loaded for transport on an exemplary bridge transporter vehicle.

Referring in more detail to the illustrative drawing figures, FIG. 1 depicts a bridge module 10, comprised of three basic individual truss-supported units 12, in place on a suitable mobile vehicle 14 such as one of the Army's standard Ribbon Bridge transporter five-ton trucks 14. The three-unit module 10 rests upon a selectively removable rectangular truck bed which often is called a pallet 16. The standard pallet of truck 14 is modified somewhat to fulfill its alternate mission to also transport and help deploy this novel tactical bridge module. The pallet modifications include provision of longitudinal side rails 18 of U-shape channel cross section which are preferably at least partially Teflon-coated, and further include lift means such as a built-in hydraulically actuated turntable means generally designated 20.

The pallet 16 is selectively releasable and removably mounted on the truck chassis being supported primarily on at least four generally corner-positioned rollers 22 which facilitate its removal to gain access thereunder to a conventional hydraulically operated chassis-mounted crane boom 40 (FIG. 5), to be further explained hereinafter.

Figure 5:
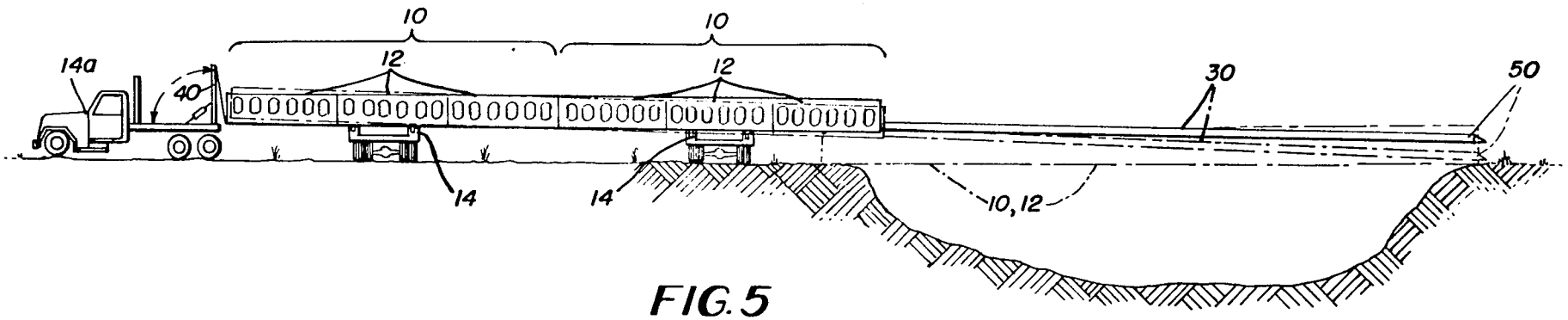
FIG. 5 is a semi-diagrammatic side view of two bridge modules unfolded and in alignment during a beginning stage of their deployment.

The three individual units 12 may be provided with readily applicable-removable retainer means such as brackets or straps, not shown. They will retain the respective units 12 in their vertically folded or collapsed condition, particularly when not otherwise collectively cradled between the side rails 18 as shown in FIG. 1. After completing the initiated unfolding depicted in FIG. 2, and also shown in diagrammatic form in FIG. 8, the module's units 12 are in elongated 180° alignment, and disposed 90° relative to the truck's longitudinal axis. Next, modules 10 are laterally unfolded or spread apart as shown in progress in the leftward positioned module 10 in FIG. 3, and as more clearly depicted in FIG. 14 on the same drawing sheet. In FIG. 3, the rightward positioned module 10 is completely unfolded and lowered via the turntable means 20 onto the Teflon or like coated side rails 18. In the same FIG. 3 portion, the partially extended truss-housed pair of traversing beams 30 have been cross-connected by a combined bearing pad-and-road ramp means 50, to be more specifically described hereinafter. FIG. 5 shows how the traversing beams 30 have been fully projected across a chasm and then positioned as represented in broken lines so that bearing pad and ramp means 50 bears in a fixable manner upon the remote shoulder of the chasm, after which the interconnected modules are power pushed across chasm on the traversing beams 30 which are progressively received back within their truss-supported units 12. Once the modules 10 are fully projected, another of the trucks 14*a*, with its self-contained crane boom 40 erected, effects elevating of the aligned modules, at least sufficiently for the nearest truck to be driven away. Thereafter, the truck 14*a* backs up against the attached module 10, forcing it rearwardly while partially sliding across the Teflon-coated truck bed rails during the beam-guided deployment. When in partial or full beam-guided deployment, the crane lifts the modules again sufficiently to enable the remaining transport-deployment truck closest to the chasm to be driven away, after which the crane lowers the near end of the elongated unfolded modules onto the near shoulder of the chasm to essentially complete the bridge deployment. This is illustrated schematically in FIG. 5, whereas the perspective view depicted in FIG. 4 clearly represents the two bridge modules 10 assembled and fully deployed, ready for use. It is understood that more than two such modules may be operably interjoined and deployed, with three such interconnected modules being a very preferred form to provide a desired approximately 180 foot integrated bridge.

Each bridge module is preferably comprised of three individual truss-supported units 12. More specifically, as seen in the drawing FIGS. 6–9, each unit 12 is made up of multiple adjoining sections of a basically two part arcuately crowned, medially hinged together roadway portion 24 and two trusses 13 preferably of the Veirendel type which are hingedly connected at lower portions via hinge means 15 to the opposite lateral sides of the roadway portion 24. Each of the trusses 13 includes essentially identical, horizontally spaced top and bottom longitudinal truss elements or tubular chord members 17 which are interjoined by heavy duty aluminum skin web 13*a*, better seen in FIG. 12. Each of the multiple sections of the roadway portion 24 is formed as a two-part circular tied arch medially joined together by hinge means 26. Hinge means 15 and hinge means 26 are all oriented to have parallel horizontal axes.

Figure 13:
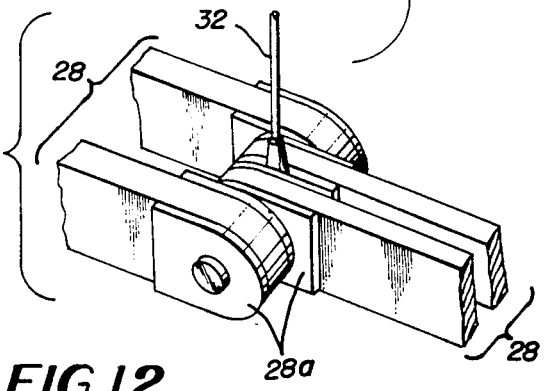
FIG. 13 is a fragmentary perspective detail view showing an exemplary pivotal connection for the tensile tie links which tie the two constituents arcuate roadway or floor sections together into a single tied arch relationship.

The opposite lateral edges of the two-part crowned roadway 24 via their hinge axes 15 are tied together in chord-like fashion preferably at a plurality of uniformly spaced locations by means of two tensile link assemblies 28 which have middle hinge points 29 directly beneath the roadway centerline hinge means 26. Some exemplary details of preferably paired links can be seen in enlarged FIG. 13. Preferably composite materials (graphite fibers, epoxy and foam material cores) are used for the identical links provided with reinforced end bearing plates 28*a*. Opposite ends of each tensile link assembly 28 is pivotally connected at the roadway outer edges preferably by means of the same hinge means 15. A flexible connector link 32 (FIGS. 7 and 12) such as a flexible cable is operably connected between roadway centerline hinge axis 26 and the middle hinge point 29 of tensile link means 28. Flexible link 32 is of a length to ensure that the aligned tensile link assemblies 28 do not drop below a chord-forming line between opposed hinge means 15. This arrangement maintains the structural strength of the tied arch arcuate roadway sections. The flexible character of the links 32 enables the roadway sections to be collapsed vertically without interference which would occur with rigid links.

As mentioned above each of the Veirendel trusses 13 includes a stiffened aluminum skin web 13*a*. This web is provided with a plurality of spaced openings 13*b* each of which preferably is reinforced or lined with a separate aluminum ring member 13*c*. The marginal edges of the ring members 13*c* are preferably crimped flat against web skin 13*a*, to then assume a stronger channel like cross section as better seen in FIG. 12.

The trusses longitudinal tubular elements 17 preferably comprise a fifty percent (50%) volume fraction of a graphite/epoxy composite material having 80 percent of the fiber aligned in the longitudinal direction. The longitudinal material has a modulus of elasticity of 50 $Mlb/in^2$. The remaining 20 percent of the fiber mix is 30 $Mlb/in^2$ modulus and is used to braid in and support the longitudinal fibers. This technique produces lightweight compression elements having a high stiffness.

Figure 10:
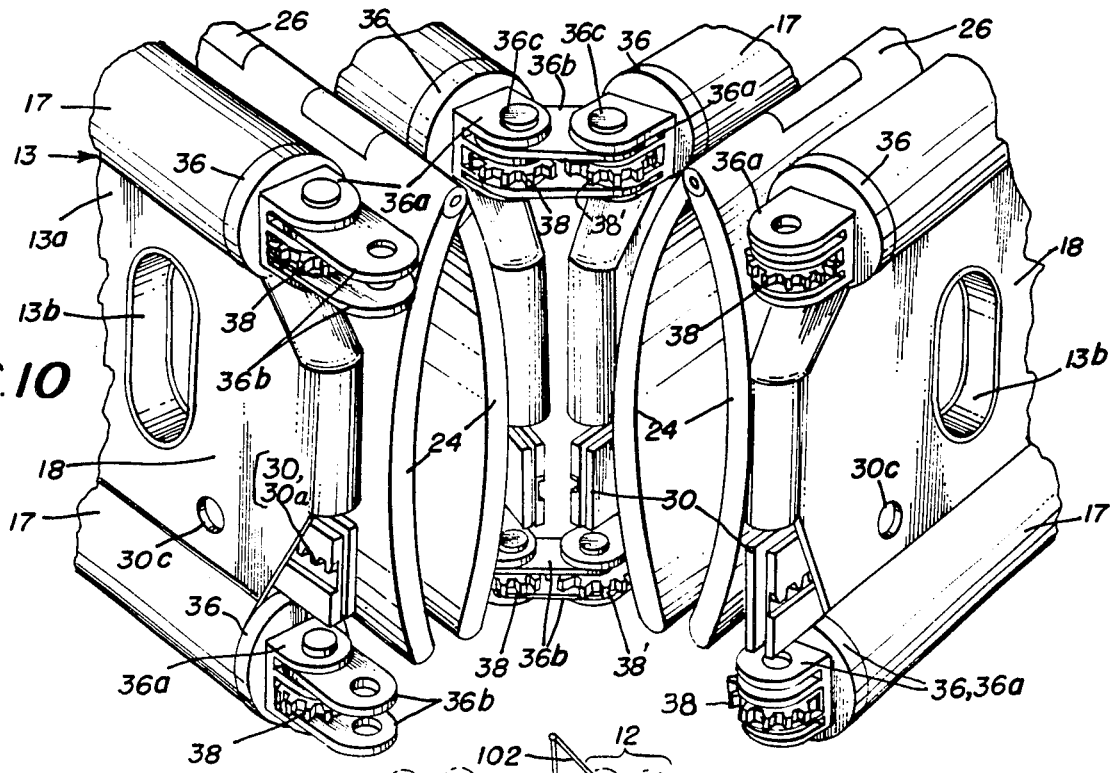
FIG. 10 is a fragmentary perspective view of adjoining truss end portions of two laterally unfolding bridge units preparatory to pinning them together when completely unfolded and aligned.
Figure 11:
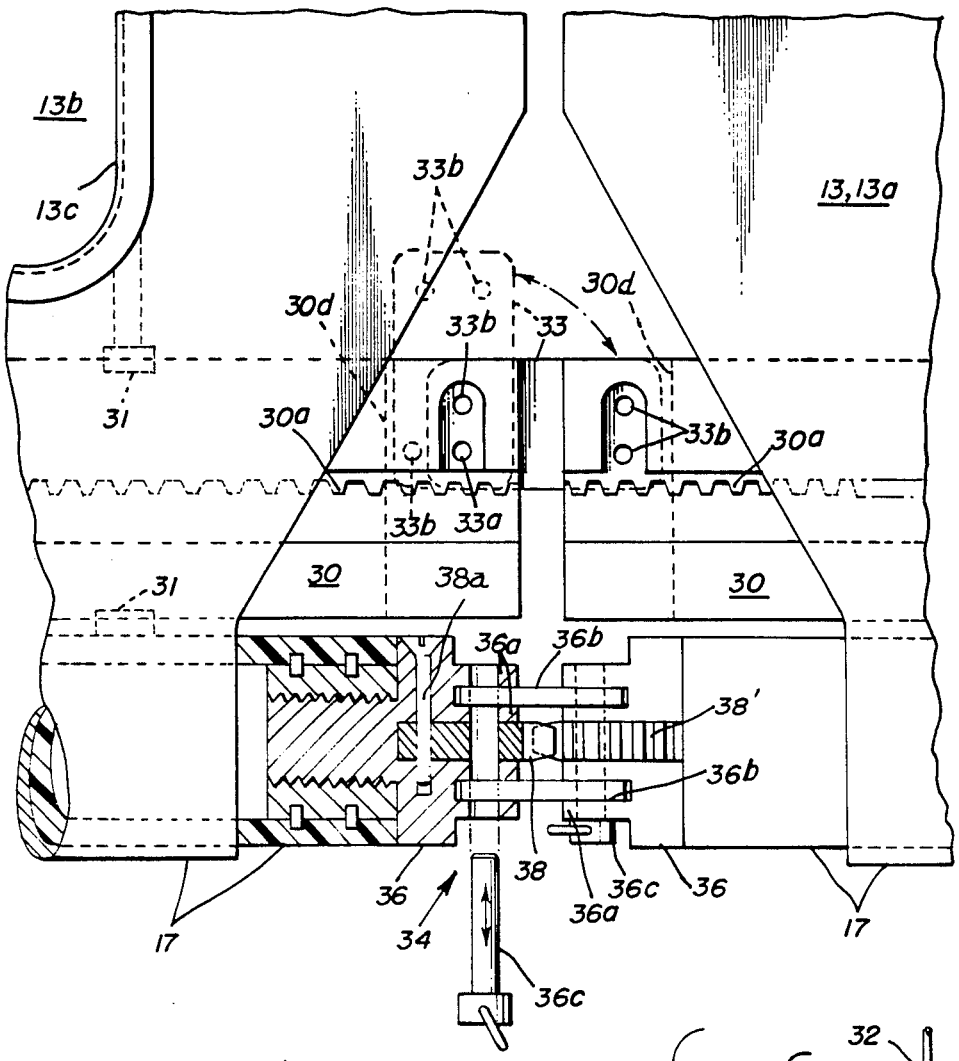
FIG. 11 is an enlarged fragmentary side elevational view clarifying some of the various exemplary details including those of the various hinged link and pin means to effect their adjoining relationships.

The truss-to-truss end hinged connections have vertical axes and preferably comprise doubled pin-and-link controlled rotation hinge assemblies 34 illustrated in FIGS. 9, 10 and 11. This is made up of four pin and link connections, two at each end of each truss member 13, each two being vertically axially aligned in the assembled condition. Each truss tube 17 has its ends provided preferably with a threaded shank clevis 36 having preferably two spaced pairs of apertured ears 36*a* (FIGS. 10 and 11) between each pair of which there is a connecting link 36*b*. Links 36*b* are removably pinned to the clevis by any suitable pin means 36*c*, which also passes through an aligned hole in spur gear segments 38 which are also separately pinned by pin 38*a* (FIG. 11) into each clevis 36. Each spur gear is adapted to operably intermesh with their corresponding oppositely positionable spur gears 38' when in the assembled functional mode. Pin means such as the aforesaid pin means 36*c* are removably usable to connect the preferably doubled link sets of the initially pin-link jointed truss sections 13 to the other adjacently disposed truss section via the apertured free end of those links 36*b*. The doubled link arrangement is used to better distribute the loads, and thereby also distributes the number of potential shear surfaces working on the pin. However, it is contemplated that single link arrangements of proper strength may be used if desired.

This arrangement of double links allows individual bridge units 12 to pivotally fold through 180° of rotation for stacking side by side in a packaged module length substantially equal to the single unit length. The center to center distance between pin holes of the links is just slightly greater than the diameter of the truss tubes 17. The rotation is controlled by the interengagement of the two fixed spur gear segments 38, 38'. Spur gear segments 38, 38' are removably mounted to facilitate replacement in the event of suffering any damage. These gears maintain a controlled relationship of adjacently disposed units during all intermediate relative pivotal movement, and assure total rigidity of the joints when the three units are fully opened or extended in their 180° alignment.

Figure 12:
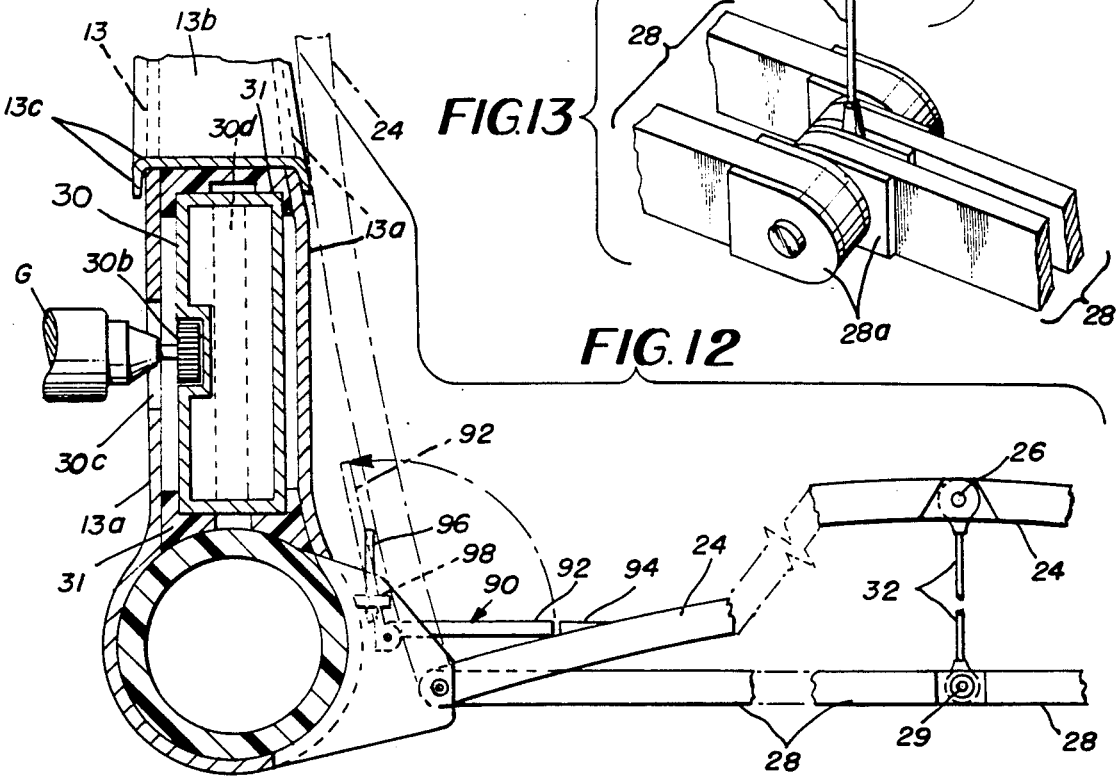
FIG. 12 is a vertical cross-sectional view also on an enlarged scale taken substantially on line 12—12 of FIG. 9, showing one preferred way of slidably supporting the traversing beam on the lower most longitudinal truss chord beam member with said beam being housed between spaced apart sheet metal walls of the truss member.

Reference is made more particularly to FIGS. 9, 11 and 12 to better understand the construction and mounting of the traversing beams 30. The beams 30 are preferably of rectangular metal box-like form, which may be approximately 4" by 12". Beams 30 are slidably supported upon the lowermost composite tubular truss element 17. Suitable antifriction means such a Teflon or the like slip pads 31 are provided both below and above each beam 30, to freely guide and stabilize it between the opposed skin webs 13*a* of the truss 13. Beams 30 are provided with suitable means for releasably interconnecting adjacent ends to form a continuous chasm-traversing beam, and are further provided with suitable means for projectably driving them out of the truss units. The latter means can include a preferably fully recessed longitudinal rack 30*a* adaptable to be drivingly engaged as by a drive spur gear 30*b* power driven by a pneumatically powered torque gun G. Access holes 30*c* in the metal skin web 13*a* provide access for the driving spur gear 30*b*. FIG. 11 better depicts one preferred means for interjoining the adjacent ends of the traversing beams 30. Said means includes providing a vertical slot 30*d* at each end of the beams 30, which slot is adapted to receive a pivotal connecting link 33 which may be prepinned at pivot point 33*a*. Link 33, which is preferably stored in the raised dashed line position (FIG. 11), is provided with three additional pinning holes 33*b* arranged in a rectangular pattern about pivot point 33*a*. Additional pin-receiving holes 30*b* are provided in the ends of beams 30 to correspondingly align with the holes 33*b* of link 33 when in the down connecting mode. Link 33 is designed so that when in the connecting down mode its top edge is flush with the top of the beams 30 to assure smooth transitioning of the truss members when traversing back and forth on the deployed beams. Recess means also are suitably provided to assure that any heads of the connecting pins do not protrude beyond the sides of the box beam 30. Most if not all of the pin means for interconnecting the various components should be similarly recessed. Suitable commercially available pins may be used, with one preferred form being of a well known ball detent type. In this form of pin usually a plurality of detent balls are retractably deployable from the shank to make a fail safe positive pinned interconnection.

Figure 16:
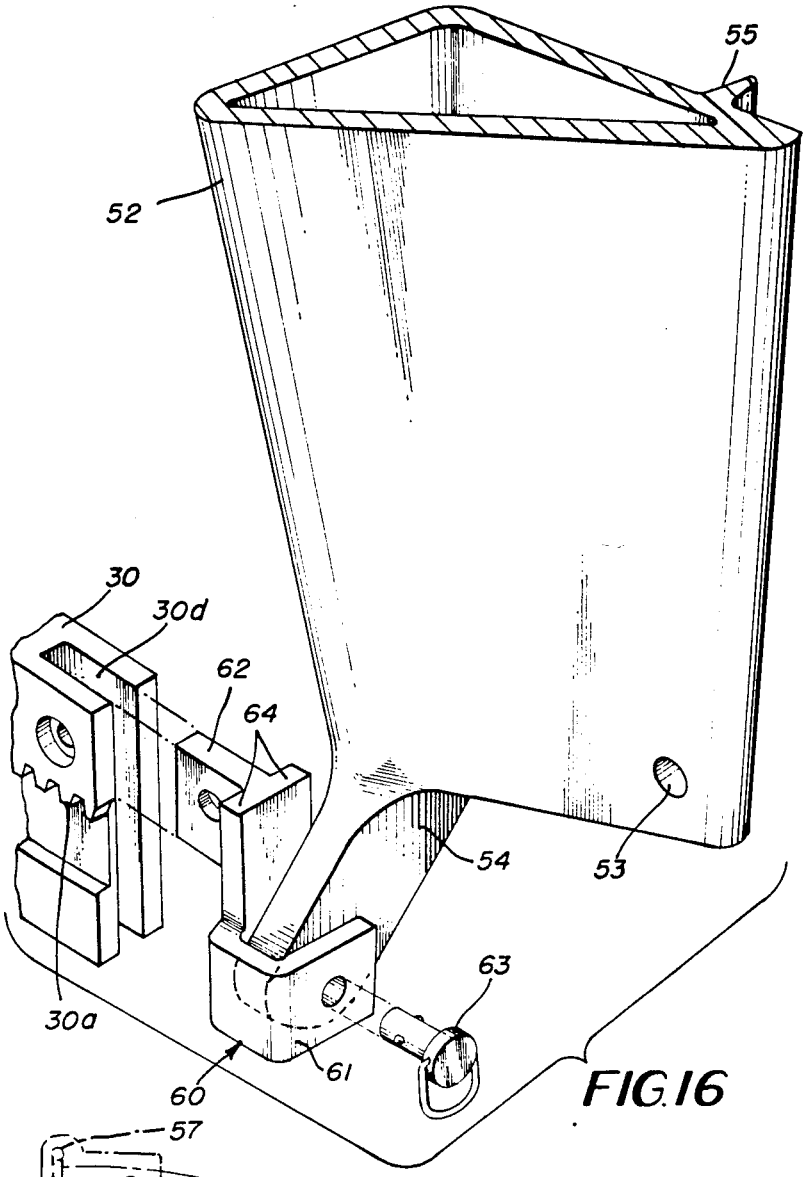
FIG. 16 is an enlarged fragmentary perspective view showing some exemplary details of one half of the selectively attachable-detachable-combined beam-bearing-pad and ramp means of FIG. 15.

The aforesaid end slots 30*d* of beams 30 are adapted to receive an additional attachment as is shown in and will now be discussed in relation to FIGS. 15 and 16. The arched roadway is approximately about 15 inches at its crowned midportion and will need a transitional ramp means 50 to accommodate vehicle traffic. While one envisioned ramp member may be fabricated in an unwieldly one-piece form (not shown) for any suitable means of attachment to the fore and aft ends of the emplaced bridge, it is preferred to make the illustrated ramp means 50 in two complementary parts 52 (FIG. 15) which will be further explained hereinafter. To accommodate the two ramp parts 52, a special right and left hand adapter clevis 60 (FIG. 16) having an apertured planar ear or wing 62 is provided, whose wing 62 is adapted to complementally fit into end slot 30*d* of traversing beam 30. Planar shoulder portions 64 disposed transversely to the plane of wing 62 are adapted to complementally abut the end faces of the beam 30. The apertured clevis portion 61 of the adapter bracket 60 has its pin-receiving axis aligned in the direction of the longitudinal axis of the beam 30. Each half portion 52 of the ramp is generally triangular cross section which progressively diminishes toward the outermost edge. Each half ramp portion 52 is provided with an integral planar ear member 54 adaptable for complemental pinned connection within said clevis portion 61 as by a commercial type ball detent pin 63. Any suitable means is acceptable for operatively joining the two part ramp members 52 together, as per the illustration in FIG. 15, and preferably at their adjoining centermost edges. One such way is to provide a complementary clevis-like arrangement 56 which may be detachably pinned as at 57, after the two portions 52, 52 are rotated downward about pivot pins 63, 63. When it is desired to store the ramp portions in a raised condition on the ends of beams 30, via adapter brackets 60, any suitable link, pin or tie means 59 may be used as schematically shown in the left hand portion of FIG. 15.

It is apparent that the two part ramp 50 is well adapted to also serve as a combined bearing pad for the projected ends of the trasversing beams 30. Because the ends of the beams 30 should be stabilized during both deployment and retrieval of the bridge modules, suitable anchoring means is provided for association therewith. One or more apertures 53 may be provided through the edge of ramp member 52 to receive a separate anchoring spike, not shown. Alternatively or in addition thereto, one or more anchor-facilitating detents or pointed webs 55 (FIG. 16) may be integrated with the lowermost edge of ramp members 52.

Upon deployment of the bridging system, an individual would manually secure the ramp 50 by inserting anchoring spikes through the apertures 53 and into the ground surface and/or by pounding the pointed webs 55 into the ground surface. If the bridge is to be retrieved, the spikes and pointed webs 55 should first be disengaged from the ground surface so that the traversing beam 30 may be retracted.

Figure 17:
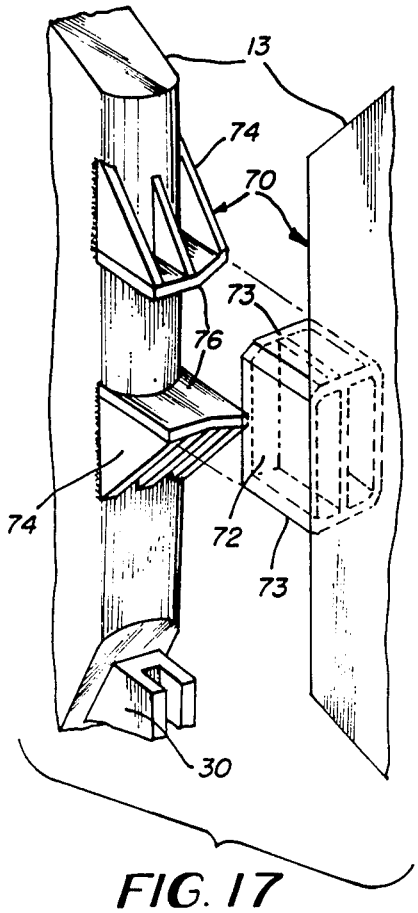
FIG. 17 is a further perspective detail view representative of one preferred form of interengageable complementary components on adjoining truss elements used to resist shear stress forces when the multiple truss units and modules are in interconnected alignment for deployment.

To provide means in addition to the aforesaid double link and pin geared hinge assemblies for further stabilizing the aligned truss members 13 during deployment, FIG. 17 shows some exemplary details of a shear-resisting interengageable mortise and tenon type structure denoted generally at 70. The exemplary structure includes a tenon-like member 72 comprised of a plurality of laterally spaced vertically oriented plates enclosed by top and bottom plates 73, 73. The mortise-forming structures 74, 74 include oppositely aligned groups of vertically disposed, preferably triangular shaped, rigid plates terminating in opposed transverse bearing surfaces 76, 76. All plate structures are rigidly welded or otherwise suitably interjoined to form the rigid mating structure. Initially mating edges thereof may be complementally chamfered or beveled to facilitate their mutual interengagement during the relative unfolding movements.

Referring to FIG. 12, a locking device 90 is operatively positioned at a lower end of each of the Veirendel trusses 13. The device includes a locking plate 92 hinged to the Veirendel truss 13 so as to be moved from an inoperative position, as shown in dotted lines on the left-hand portion of FIGS. 7 and 12, to an operative position, as shown in solid lines in FIGS. 7 and 12. A shoulder portion 94 is provided on the arcuate roadway portion 24 so as to engage the locking plate 92. As illustrated in FIG. 12, a transversly pivotal lever 96, shown in phantom, is utilized to maintain the locking plate 92 in its down locked condition. Lever 96 is adapted to pivot on pin 98, and when rotated down, its planar side is adapted to engage against the squared lower edge of locking plate 92. The locking plates 92 should be positioned at least at each end of each twenty foot longitudinal half roadway section of each unit of the bridge module. The roadway portions do not necessarily have to be constructed in twenty foot lengths. They may be fabricated in much shorter uniform length subsections, such as in ten foot or five foot subsections. Any suitable means such as locking pins insertable into aligned holes of adjacent subsections (or adjacent units and modules) would be provided to affix each subsection or unit together so as to more securely hold the sections in an aligned operative mode more particularly when the bridge is being traversed by vehicular traffic.

Figure 15:
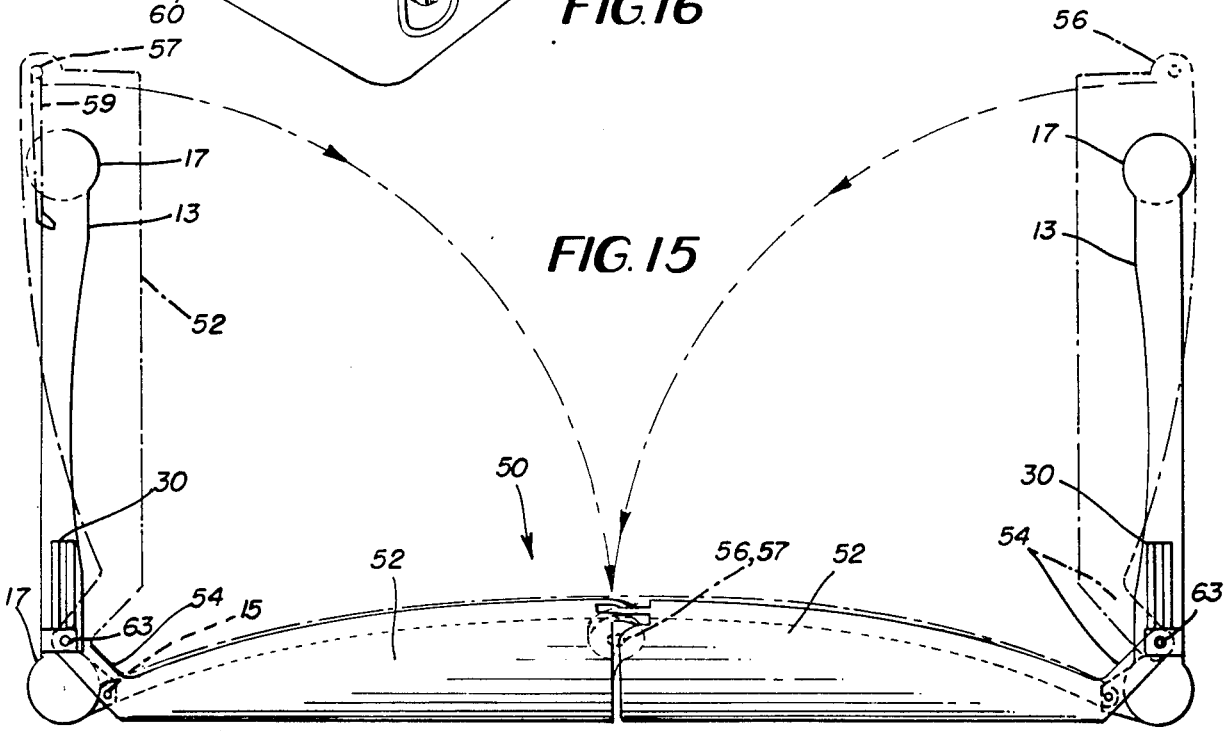
FIG. 15 is an end view somewhat like FIG. 7 but showing a folding interconnectable relationship of end-attachable, preferably two-part combination beam-bearing-pad and bridge ramp means.

As illustrated in FIG. 15, the two part ramp 50 is shown in dotted lines in a stored position. The two ramp parts 52 are moved to the solid line position when the bridge is in the deployed state. The ramp includes a pinned clevis portion 56, 57 which engages with each other so as to secure the two half sections 52, 52 together when the bridging system is deployed.

Figure 2:
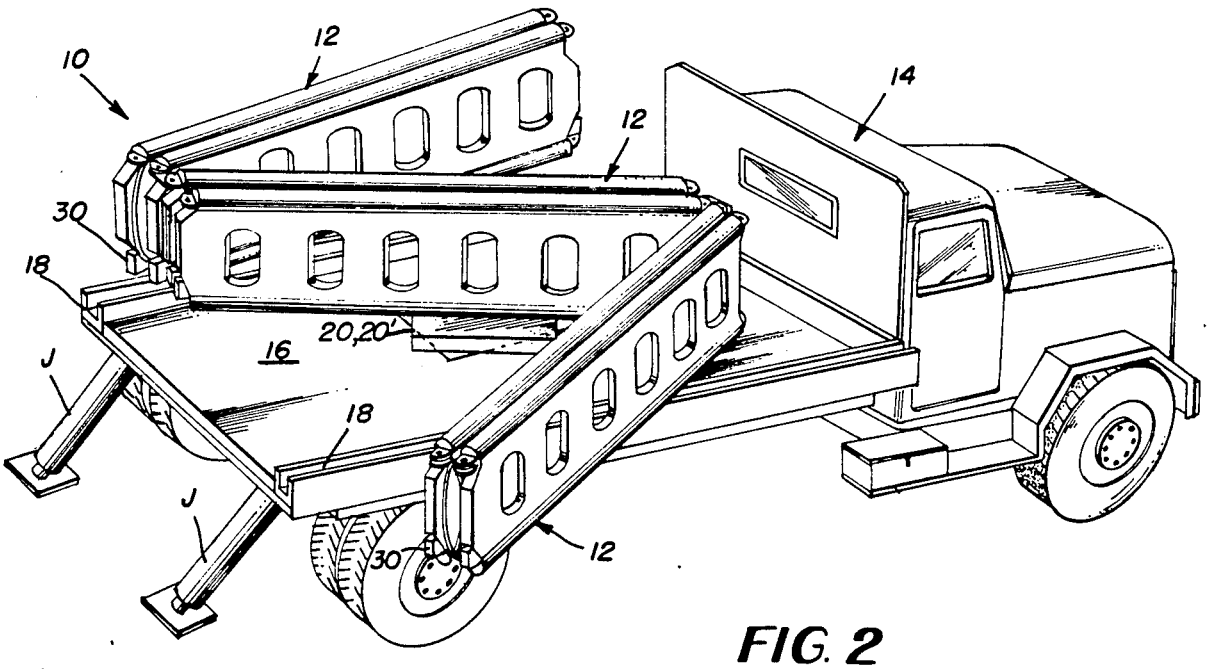
FIG. 2 is a perspective view which illustrates the unfolding of the bridge module.
Figure 7:
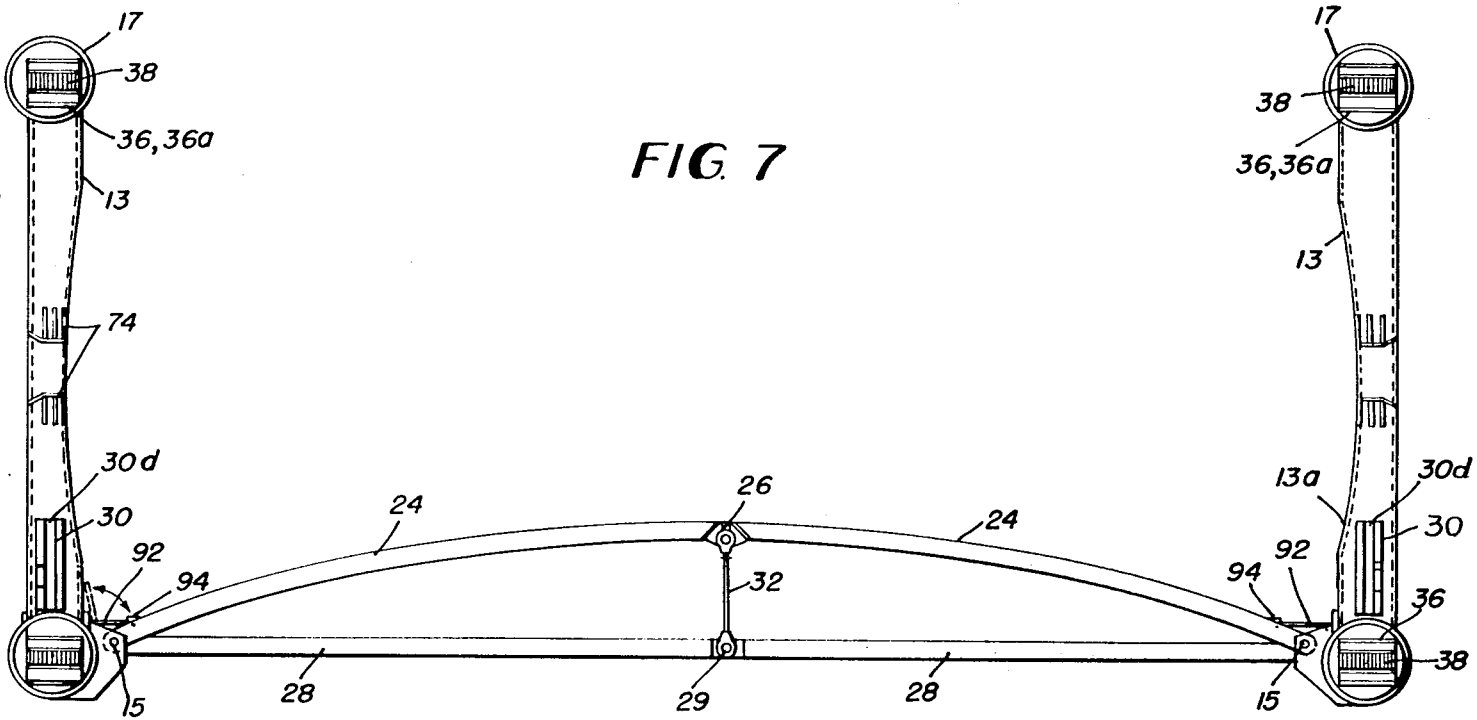
FIG. 7 illustrates the same end view but with the module components unfolded in place ready for use as a bridge.
Figure 6:
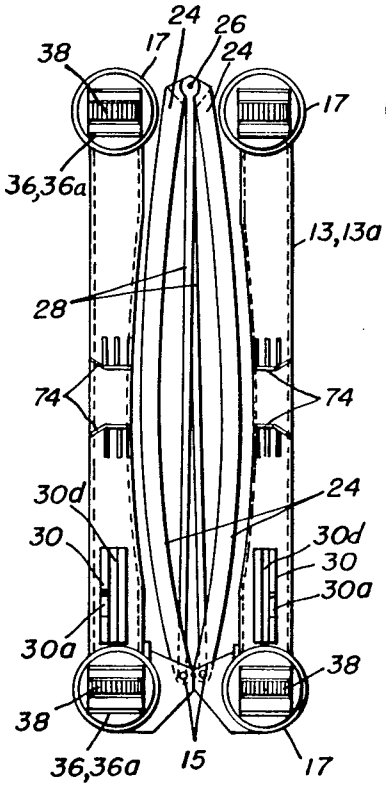
FIG. 6 illustrates a slightly enlarged end view of one unit of the module components in its vertically folded position.

Referring to FIGS. 1 and 2, the turntable means 20 includes a turntable 20' which is operatively connected to a hydraulic lift 21. In the stored condition, as illustrated in FIG. 1, the bridge units 12 are positioned so as to be in a side-by-side arrangement and the turntable 20' is actually positioned below the bed of the truck 14. When it is desired to deploy the bridge modules 12, the hydraulic lift 21 is actuated to raise the bridge modules 12 above the truck bed pallet 16. The turntable 20 includes recessed guides 25 for supporting linkage members which will be described hereinafter.

Figure 18:
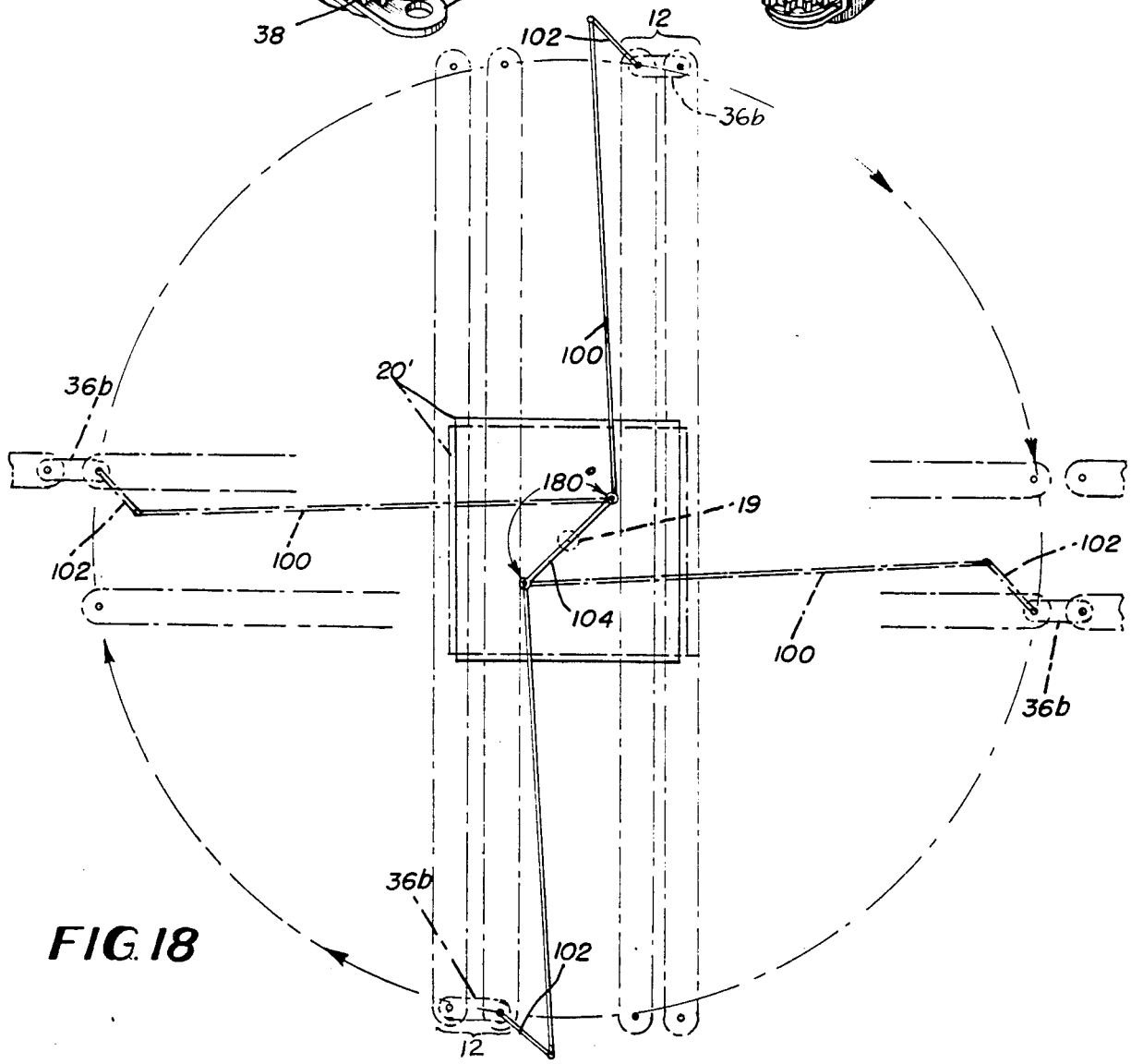
FIG. 18, depicted on the same sheet as FIG. 10, is a diagrammatic top plan view of an exemplary turntable and linkage and/or gear train means to effect lateral unfolding rotation of the respective two outside bridge units through 180° relative to the center bridge unit responsive to only 90° rotation of said center unit via rotation of said turntable.

Referring to FIGS. 8 and 18, the turntable 20' includes a pair of elongated simple tension-compression links 100, 100 which at one end operatively connect with the underside of the turntable 20' and at the other end with the short module-actuating links 102, 102, which links 102 are in turn releasably interconnected with respective end portions of opposite sides of the center unit 12 of the three-unit folded module 10. Non-round complementary pin and socket means of a socket wrench type can be used to facilitate each attachment-detachment of the link ends to the turntable and bridge unit ends. The location of any force carrying members such as links 100, 102 must generally be below or inside of the collapse module units. The centerline-to-centerline length of the short module-actuating links must be equal to the distance from the center of the turntable rotation shaft 19 out to the centerline of the socketed connection of the link 100 to said turntable 20'.

In order to keep the force structure equal, the tensile-compression links 100, 100 must start and end at positions which are 45° off the longitudinal centerline of the centermost bridge unit. Any suitable means are used to achieve a two to one (2:1) multiplication factor in the rotation of the two outside bridge units so that they rotate 180° while the center unit on the turntable rotates only 90°. This may be in any suitable form of planetary gearing, belt and pully, or possibly hydraulically driven gear transmission means or the like. This 2:1 drive ratio achieving means for purposes of simplification here in the illustrative drawings is represented by the intermediate diagonal linkage 104.

The bridge module system is balanced on the turntable as long as both outside bridge units 12 rotate uniformly together in their opposite-hand manner. The linkage system is designed so that the outside units initiate their respective opposite rotations at the same time that the turntable begins to rotate. Therefore, responsive to the turntable rotation and related power transmission means providing the 2:1 ratio multiplication factor, and further via said linkage 100, 102, rotation is effectively imparted to the respective second set of top and bottom spur gear segments 38' via the socket wrench type of connection of link 102 with the initially cross connected link **36*b* (FIGS. 8 and 10). This socket wrench type connection forms a type of fixed angular bellcrank type lever out of link 102 and, the related cross link 36*b*, which via gear segments 38' pivotally forces each outside bridge unit to rotate outwardly away from the center unit, as per FIG. 8. In the upper portion of schematic FIG. 18, one of the cross links 36*b*** has been shown in phantom as connected to the end of the adjacent bridge unit.

The foregoing referenced interaction between adjacently meshed spur gear segments, together with the continuing rotation of the turntable, collectively help effect the unfolding and extending of the two outside bridge units into a 180° aligned relationship with the center bridge unit. This is all done while the units remain in their vertically collapsed first folded condition. The energy to rotate the bridge module in this condition is considered to be relatively minimal because all of the movement takes place in a vertical plane which is perpendicular to the horizontal pull of gravity.

Upon rotating the three bridge modules 12 into the unfolded 180° extended position and oriented at approximately 90° with respect to the longitudinal axis of the truck bed pallet 16, the hydraulic lift 21 is again actuated to lower the turntable 20' so as to permit the central Veirendel truss 13 to engage the support channels 82 of the aforedescribed screw mechanism 80. Thereafter, the brackets 82, 82 are extended outwardly, as illustrated in FIG. 14, to slowly unfold the bridge modules 12 so that the arcuate roadway portion 24 is in its operative position and the Veirendel trusses 13 are positioned and locked at approximately 90° with respect to the arcuate roadway surface 24.

Referring to FIG. 8, the linkage members 100, 102, if necessary, may extend beneath a recess at the back of the truck cab. FIG. 2 indicates a recessed portion beneath the truck cab which may be provided to accommodate the linkage members 100, 102 if the truck bed pallet is of insufficient length. With reference to FIG. 18, the linkage members 100, 100 are initially stored in the recesses 25 in a substantially parallel relationship when the bridge units 12 are in the folded condition.

OPERATION—DEPLOYMENT

In using the bridge, as previously noted, the expansion from the folded or transport condition to the load-carrying bridge configuration is accomplished while the bridge is still on the truck. This expansion is brought about in the following manner:

a. The folded bridge package is raised slightly, about 2 inches, in order to clear the side rails 18 of the truck 14, by a hydraulic turntable means 20 which is part of the truck's pallet 16.

b. The package is rotated 90° on the turntable.

c. As the package rotates 90°, the outside bridge units rotate an additional 90° each about their pinned connection to the center unit for a total 180° rotation. The outside unit rotation is programmed to and powered as by any suitable lever and gear train means operatively associated with the turntable so as to achieve the requisite 2:1 ratio of movement.

d. With the three bridge units located in a straight line which is perpendicular to the truck bed, the roadway contained in the units is expanded on the turntable by a controlled simple screw mechanism means denoted generally at 80 in FIG. 14.

e. The bridge module is locked into a fixed open channel configuration and is lowered by the turntable onto the side rails 18 of the truck or transporter vehicle 14.

The extensible traversing beams 30 of individual truss elements 13 are manually pinned together after the horizontal unfolding expansion.

In order to put the expanded bridge into place, the following steps are taken:

a. Preferably a pneumatic torque wrench (pneumatic pressure is available on the truck) is used to slide the previously interjoined beams 30 in and out within interconnected units.

b. A boom crane 40 (FIG. 5), on a second bridge truck for example, is utilized to lift the bridge from its supporting side rails 18 and position it so that its projected, traversing beams 30 touch down on the far bank. The assembly of interconnected bridge modules are then pushed across the gap on the beams which beams are progressively received back within the modules as the assembly traverses the chasm.

c. Preferably up to three truckloads of bridging modules can be connected together while resting on the truck beds, in an expanded condition, through the use of the traversing beams and associated componentry. This is not a close alignment task since three different degrees of freedom are provided by the combination of the traversing beams and turntables. The trucks 14 have built-in hydraulic jack means J (FIG. 2) which are used to help level and/or adjust the attitude of the truck bed. This feature helps with the interconnecting alignments as well as with deployment.

d. The retrieval procedure is essentially a reverse of the emplacement and can be readily retrieved from either side. Only the two-man crews of the bridge transporters are required to emplace and retrieve the entire structure.

Reverting back to the first described step d relative to the unfolding operation of the bridge module, a further description of screw means 80 is made herewith in conjunction with the illustrative drawing FIGS. 8 and 14. When the still vertically collapsed or folded roadway and truss segments are in the position and condition described in said step d, the centermost bridge unit is lowered into the prepositioned pairs of channel brackets 82, 82, FIG. 14, which brackets are disposed in both longitudinal side rails 18. Brackets 82, 82 have threaded apertures near the bottom to accommodate opposite hand threads of an elongated oppositely threaded turnbuckle shaft 84. Located between channel brackets 82, 82 and connected to the center of the threaded shaft 84 is a rotary nut, spur gear or other suitable drive means 86 which may be operatively associated with or be a component part of a suitable known type of hydraulically operated screw mechanism, such as manufactured by various companies including The Philadelphia Gear Company.

Supplemental to the turntable operation, it is preferred that the turntable be first completely elevated by conventional hydraulic lift means 21. Thereafter a known type of hydraulic rotary actuator means, not shown but which is operatively built into the turntable means 20, is used to effect the desired 90° rotation of the turntable. One such commercially known unit is called the Rotac unit. It is further understood that any suitable gear train means and associated linkage means may be devised to achieve the desired 2:1 ratio movement which enables the two outermost bridge units 12, 12 to rotate a full 180° to provide the fully extended and aligned position of all three units while the turntable is only rotated through 90°.

Referring again to the method of deploying the extended, aligned bridge units, an alternative mode is to progressively balance the interengaged aligned modules on progressively fewer support trucks, until only the last truck adjacent the chasm is supporting the connected assembly. Under such circumstances, a large length of the bridge assembly is already projected significantly over the chasm, thereby greatly reducing the extent to which the traversing beams need to be driven out until they are ready to bear down upon solid ground of the far shoulder of the chasm. Accordingly, a much lesser distance remains for which the extra drive truck has to drive or power move the assembled modules across the beams 30 to complete deployment thereof.

The invention is deemed to include not only the compact dual foldable character of the modules, and the overall system thereof, but also the associated methods of unfolding and deploying the packaged modules for operative use.

From the foregoing disclosure, it is apparent that a greatly improved modular bridge system has been evolved which provides greater spans of bridging which can be deployed much more quickly with less equipment and fewer men. The prior art current tactical bridging has high mass and bulk which heretofore concentrated more on bridge structure rather than upon its efficient transport and deployment. The Army's current standard bridge has a limited span of normally 30 meters, which can be laboriously lengthened up to 50 meters via use of a time-consuming expensive kit. Said current prior art bridge requires five trucks and four trailers to transport only 30 meters of bridge and requires 25 men to work 3 hours to emplace it. By comparison, the new bridge system of the present application can transport 36 meters of bridging on only two trucks, or 48 meters on only three trucks, all of which can be set up in less than one half hour by the two-man truck crew and deployed from the transporter vehicles with the help of another truck having a small built-in lift crane. Accordingly, this new system provides for one or more optimum packaged, truck transportable, folded bridge modules, which modules are prefabricatable in compact modular units. It is, therefore, apparent that these new modules will provide greater linear bridging per truck, usually up to 18 meters or about 60 feet. These new modules are readily interconnectable to achieve rapid emplacement of spans up to 54 meters or about 180 feet. Even greater span coverage is contemplated based upon the same prefabricated modular principle by modifying the structural engineering to satisfy the loads of any greater comtemplated spans.

The invention being thus described, it will be obvious that the same may be varied in many ways. Such variations are not to be regarded as a departure from the spirit and scope of the invention, and all such modifications as would be obvious to one skilled in the art are intended to be included within the scope of the following appended claims.

What is claimed:

1. A vehicle transportable, multi-foldable, multi-sectional prefabricated bridge module comprising:

a. multiple bridge units interconnected to constitute the foldable bridge module;

b. each bridge unit comprising a roadway portion which includes dual laterally spaced, truss-supported, longitudinal medially divided, roadway segments which are foldable via i. first hinge means to pivotally connect and provide relative folding of separate laterally spaced trusses and corresponding divided roadway sections at laterally opposite edges about horizontal parallel axes; and ii. second hinge means at the centerline of said roadway portion and having an axis parallel to the axes of said first hinge means for pivotally connecting said medially divided roadway sections together and for permiting said roadway sections to be first foled into collapsed essentially vertical side-by-side relationship;

c. third hinge means having vertical pivot axes and operatively connected to top and bottom end portion of said spaced trusses, to provide for both i. selective interconnection of adjacent bridge units, and ii. for permitting their respective pivotal folding around said vertical axes between two positions, one of which:

(a)' is side-by-side compactly folded while in said vertically collapsed condition, and the second (b)' is a subsequent 180° unfolded elongated aligned orientation also while still vertically collapsed preparatory to further unfolding and deployment; and d. each truss having an elongated high strength traversing beam coextensive therewith and with means for slidably mounting it within each truss, said beams having means for releasably interconnecting said beams in end-to-end relation when said bridge units are unfolded into 180° alignment; means associated with said traversing beams for effecting beam projection out from said module and across a chasm to be bridged, with said module adapted to traverse the chasm on said traversing beams while receiving the traversing beams back interiorly therewithin;

e. whereby said multi-foldable bridge units are uniquely characterized by their vertically collapsible and bilateral foldability and their self-contained traversing beams with the two distinct 90° orthogonally oriented sets of hinges and hinge axes for the foldable units during related orthogonal folding precedures, thereby providing greater linear feet of bridging per module in more compact, prefabricated, readily transportable modular form.

2. The foldable bridge module of claim 1, in which the multiple bridge units of paragraph a. include a multiple of three essentially identical bridge units foldably interconnected together by at least portions of said third hinge means recited in paragraph c.

3. The foldable bridge module of claim 1, wherein said medially divided roadway portion includes two longitudinal half segments of complementary arcuate cross-section, and further including tensile link means for effectively tieing said roadway segments together and for maintaining them in a useable tied arch roadway mode;

said tensile link means adapted to operatively extend in a chord-like manner on a chord line between and be operatively connected to horizontal hinge axes at opposite lateral sides of said roadway portions.

4. The foldable bridge module of claim 3, further including lock means to lock the trusses and roadway segments in their generally 90° unfolded, road useable condition.

5. The foldable bridge module of claim 3, wherein said tensile link means includes at least one pair of equal length rigid link members having pivotal connecting means with a pivotal centerline disposed directly below said second hinge means connecting said longitudinally divided roadway segments, and associated link support means to preclude the link members from dropping below the chord line.

6. The foldable bridge module of claim 3, wherein longitudinal roadway segments are comprised of a plurality of subsections adapted to coact in unison.

7. The foldable bridge module of claim 1, wherein the means for effecting projecting said traversing beams also is used to retract said beams back within said trusses, said means comprising rack and pinion gear means including an elongated toothed rack member coextensive with each of said traversing beams.

8. The foldable bridge module of claim 1, wherein said third hinge means includes a clevis member at the top and bottom of each truss end, and link-and-pin means including at least one link member at the top and bottom with each clevis member operably and selectively connectable with said clevis members, and a clevis-attachable gear segment with a center of its pitch diameter coaxial with said third hinge means pivot axes.

9. The foldable bridge module of claim 8, wherein said clevis members each have dual spaced pairs of ears; and dual pairs of link members, one each selectively pinable in each of said dual sets of clevis ears.

10. The foldable module of claim 1; further including combined bearing pad and access ramp means adapted to be selectively attached to and detached from exposed ends of said traversing beams when preparing to deploy said bridge module.

11. The foldable bridge module of claim 1, wherein each of the multiple bridge units includes complementally coacting shear-resisting means to supplement said third hinge means, which coacting shear-resisting means are disposed on opposite ends of said units positioned intermediate said top and bottom disposed third hinge means.

12. A tactical bridge system more particularly including and for effecting deployment over relatively dry chasms of interconnected foldable bridge modules of the multi-unit type defined in claim 1, said system comprising and utilizing in combination:

a. at least one of the aforesaid multi-unit folding bridge modules;

b. a transporter truck for transporting and helping deploy each of said folding modules, each truck including i. a module-supporting truck bed in the form of an elongated support pallet, ii. a power driven turntable for rotatively supporting said foldable module which is in a vertically collapsed condition;

ii. means for selectively elevating and rotating said turntable to rotate the folded module through about 90°;

c. said truck bed pallet including side rail means of open top channel form, and controllable screw and screw-rotatable power driving means operatively associated with said side rail means to effect controlled unfolding of said module's roadway portions form its vertically collapsed condition into a laterally full opened potentially useable condition preparatory to deployment.

d. combination bearing pad means and lateral tie means for laterally interconnecting the laterally spaced pair of the module's self-contained traversing beams together during initial steps of projecting the traversing beams across the chasm during deployment of the bridge module; and e. power assist means for both appropriately supporting the end of said extended multi-unit module which end is most remote from the chasm, and also for power assist imparting of traversing movement to said module to effect its traverising deployment across said traversing beams while receiving said traversing beams back interiorly therewithin.

13. The bridge system of claim 12, wherein said system includes three of said foldable bridge modules each folded upon corresponding respective transporter trucks; whereby at least a two man crew from a transporter truck vehicle can effect greatly simplified and greatly reduced time deployment of said system.

14. A method for emplacing a bridge apparatus, and more particularly for emplacing at least one folded bridge module having three pivotally connected bridge units, with each unit embodying dual vertically collapsible hinged roadway sections add dual trusses of the type recited in claim 1, and which module has been initially placed on a liftable rotatable turntable of a transport vehicle with the three bridge units with their roadway sections and trusses didposed in their first-folded vertically collaped position and second folded side-by-side relation, and oriented with the longitudinal axis of the units in the same fore-and-aft longitudinal orientation as that of the transport vehicle, and which vehicle has transported the bridge module to a site adjacent a chasm to be bridged thereby, said method comprising the steps of:

a. positioning the transport vehicle with its longitudinal axis generally closely parallel to the longitudinal axis of the chasm;

b. raising the folded bridge module slightly via the liftable turntable to overcome frictional drag against the support vehicle;

c. rotating the elevated module via the turntable to travel approximately 90° relative to said longitudinal vehicle axis with at least the center unit of the three bridge units supported directly on said turntable;

d. simultaneously further rotating the two outside bridge units in opposite directions away from their pivotal connections at opposite ends with the center bridge unit to unfold them from their second folded condition, so that said bridge units unfoldingly travel apparoximately another 90° in a balanced manner thereon and extend into elongated 180° alignment with each other and with the center bridge unit such that a significant portion of the bridge apparatus projects out over the chasm;

e. connecting adjacent ends of the unfolded bridge units rigidly together; and also rigidly connecting adjacent ends of traversing beams which are coextensive with and self-contained within each bridge unit;

f. laterally unfolding the collectively joined bridge units from their initially stored first-folded vertically collaped condition into a laterally unfolded open roadway system;

g. sliding said connected traversing beams so that they project at least partly out of said bridge units sufficiently for temporary anchored or fixed support bearing on an opposite remote side of the chasm;

h. lifting the aligned collectively joined bridge units from the end opposite the end projecting over the chasm, while using the supporting transport vehicle as a fulcrum point until the remote ends of said traversing beams fixedly engage and bear supportingly upon the opposite remote shoulder of the chasm;

i. then moving said bridge units along the projected traversing beams over the chasm while receiving the beams back within said bridge units upon completion of their traversal over the chasm; and j. finally lowering said lifted end until it bears down securely upon the near shoulder of the chasm to complete the said emplacement including a temporary secuting thereof to said chasm shoulder.

15. The method of claim 14, in which at least three of the folded bridge modules as separately transported to an eplacement site are emplaced across a chasm, said method prior to steps g–j of claim 14 further including the steps of:

unfolding each module as generally described into its 180° open aligned orientation on its respective transport vehicle;

progressively positioning the second and third vehicles so as to sequentially align their extedded bridge modules into alignment with the first positioned vehicle; and adjusting respective truck attitudes as may be necessary to assure all proper alignments of the modules and then completing a releasable interconnection of all aligned modules and of their self-contained traversing beams.

16. The method of claim 14, wherein step g further includes interjoining laterally opposed ends of the traversing beams with combination bearing pad and access ramp means.

17. The method of claim 14, wherein step g further includes interjoining laterally opposed ends of the traversing beams with combination bearing pad and access ramp means; and prior to step j furtber adding a like combination bearing pad and access ramp means to the end of the bridge unit most remote from the chasm to effect temporary fixed emplacement thereof.

18. The method of claim 14, wherein step f further includes the placement via said liftable turntable of lower edges of dual trusses of dual truss-supported roadway segments making up a bridge unit into guide brackets disposed in spaced guide rail channels on opposite support bed edges of the transport vehicle, and then using power assist means including a rotatable shaft having oppositely threaded portions cooperating with said guide brackets in said guide rail channels to produce a controlled lateral unfolding in said step f.

19. The method of claim 14, following step f and before step g, which further includes relatively and releasably locking hingedly interconnected truss and roadway sections in their unfolded roaduseable condition at approximately 90° relative to one another.

20. The method of claim 14, wherein the retrieving of the emplaced foldable bridge apparatus comprises the reverse procedure of steps a. thru j., but preceded by releasing any temporary emplacement anchoring of the traversing beams and bridge unit on a shoulder of the chasm.

* * * * *